United States Patent [19]

Agresta

[11] Patent Number: 5,010,922

[45] Date of Patent: Apr. 30, 1991

[54] ACCESSORY FAUCET HAVING QUICK ATTACHING MEANS

[75] Inventor: Frank J. Agresta, Wallingford, Conn.

[73] Assignee: WPM, Inc., Waterbury, Conn.

[21] Appl. No.: 579,678

[22] Filed: Sep. 10, 1990

Related U.S. Application Data

[60] Continuation-in-part of Ser. No. 525,069, May 18, 1990, which is a division of Ser. No. 448,526, Dec. 11, 1989, Pat. No. 4,967,784.

[51] Int. Cl.[5] ..... E03C 1/02

[52] U.S. Cl. ..... 137/359; 137/216; 137/801

[58] Field of Search ..... 137/216, 359, 801

[56] References Cited

U.S. PATENT DOCUMENTS

| | | | |
|---|---|---|---|
| 4,635,673 | 1/1987 | Gerdes | 137/216 |
| 4,771,485 | 9/1988 | Traylor | 137/359 X |
| 4,848,395 | 7/1989 | Krippendorf | 137/801 X |

*Primary Examiner*—Gerald A. Michalsky
*Attorney, Agent, or Firm*—Dallett Hoopes

[57] ABSTRACT

The faucet is installed with the use of a pair of interfitting plates, one, the base plate, secured to the bottom of the faucet base, the other, the installation plate, secured to the sink over the access hole in the sink. The installation plate has upstanding elements which fit into narrowing openings in the base plate. When the plates are brought together and the base is turned for 20° or so, the elements wedge against the sides of the openings respectively to give a tight fit, securing the faucet to the sink. A resilient seal urges the faucet base upward, enhancing the attachment.

13 Claims, 3 Drawing Sheets

ACCESSORY FAUCET HAVING QUICK ATTACHING MEANS

CROSS REFERENCE TO RELATED APPLICATION

This application is a continuation-in-part of U.S. Pat. application Ser. No. 525,069 filed May 18, 1990, which is a divisional of U.S. Pat. application Ser. No. 448,526, filed Dec. 11, 1989, now Pat. No. 4,967,784.

BACKGROUND OF THE INVENTION

This invention relates to accessory faucets, or so-called "third faucets", which are usually installed on the sink top to the side of the traditional hot and cold water faucets. The accessory faucet is connected to a source of filtered water usually in the form of the outlet of a reverse osmosis filter.

In the Gerdes U.S. Pat. No. 4,635,673 issued Jan. 13, 1987, the installation of an accessory faucet is accomplished by sticking the threaded inlet pipe down through a hole made in the sink top and laboriously from underneath the sink threading upward a nut and metal washer wide enough to clamp against the underside of the sink about the hole. Such installation has not only been awkward but has been time-consuming.

IDENTIFICATION OF RELATED ART UNDER §§1.97 and 1.99

Aside from the above mentioned Gerdes patent, there are further showings of such faucets. Examples are Pat. Nos. 3,620,241; 3,967,638; 4,134,419; 4,210,533; 4,454,891.

SUMMARY OF THE INVENTION

While the arrangement shown in the Gerdes patent is meritorious in every respect, the present invention relates to improvements on the structure disclosed in Gerdes.

The invention may be described as a quick-attaching means for installing the accessory faucet with or without an air break module on the sink top. It comprises a pair of plates, one, the base plate, secured to the bottom of the faucet base; the other, the installation plate, secured to the sink around the access hole. The installation plate has upstanding elements which fit into tapered openings in the base plate.

The threaded pipe and other connections are fed through the opening in the base and installation plates. The faucet base assembly housing is turned a fraction of a turn to tighten it. This eliminates under-the-counter work and a lot of manipulating and rotating of the usual attachment nut by the plumber in the installation of the faucet.

BRIEF DESCRIPTION OF DRAWINGS

Other objects and features of the invention will be understood by those skilled in the art from a study of the following specification and drawings, all of which show nonlimiting embodiments of the invention. In the drawings.

DESCRIPTION OF THE PREFERRED EMBODIMENT

Figure 1:
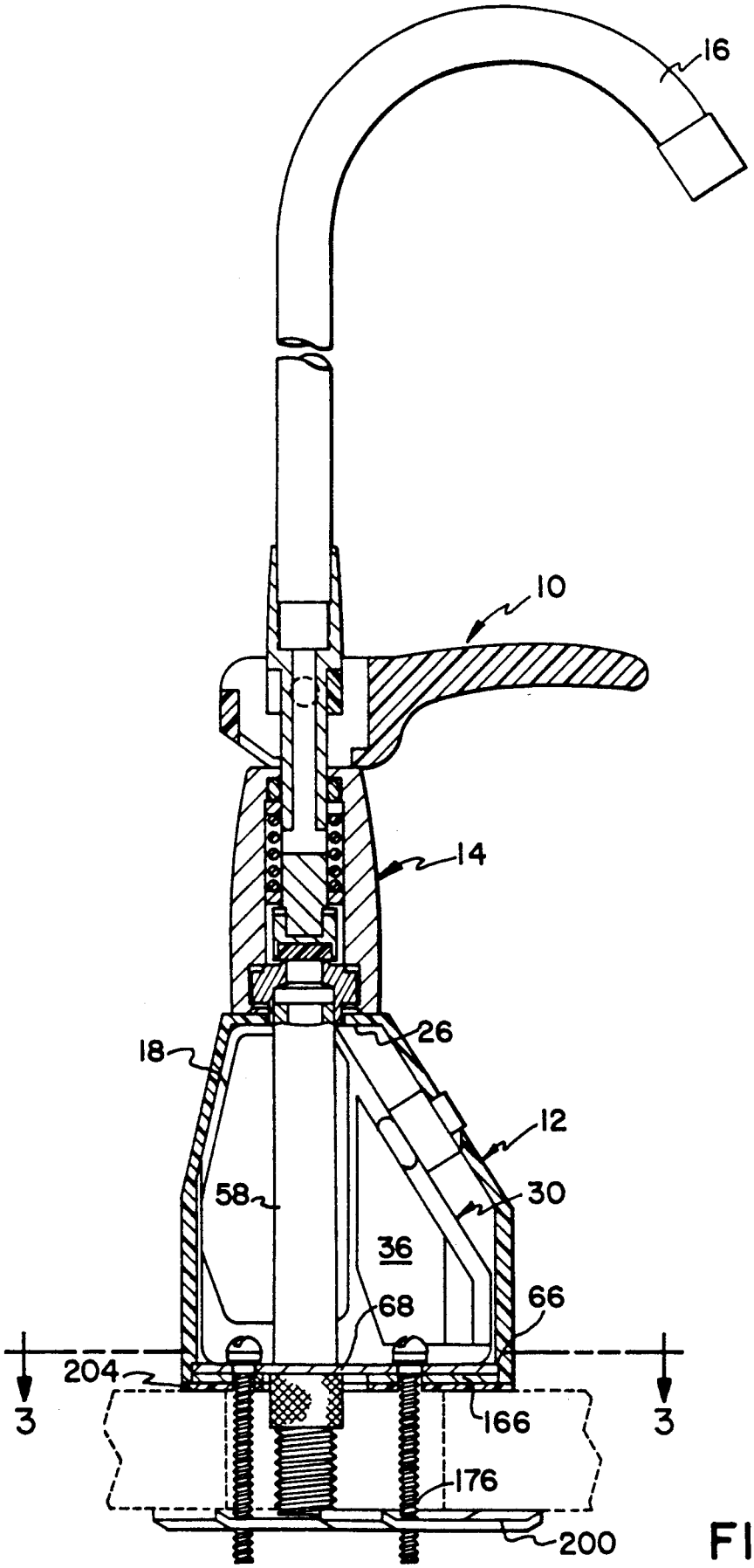
FIG. 1 is a vertical centerline sectional view of an embodiment of the invention having the plate base and installation plate partly broken away through the attachment elements. The sink is shown in phantom.

An accessory faucet embodying the invention is shown in FIG. 1 and generally designated 10. It comprises a base assembly 12 containing an air break and an in-line valve assembly 14 mounted thereabove on the supply pipe 58. A swivel spout 16 extends upward from the valve assembly as shown.

Base assembly 12 comprises an inverted cup-shaped housing 18. The top wall of the housing is apertured at 26. Inside the base assembly 12 may be an air break module 30 as described in the parent applications.

A base plate 68 (FIG. 2) is circular and is formed with an opening to receive the pipe 58 and with keyways 150 in its periphery. In assembly, the keyways 150 receive short longitudinal ribs (not shown) in the bottom of the housing to keep the base plate 68 keyed to the rotation of the housing 18 as the unit is installed. Plate 68 is formed with opening 70 and enlarged aperture 154 (FIG. 2) which receives the brine outlet hose and fitting 42 and brine inlet hose and fitting 40 as well as the wire from a monitoring device which measures the quality of the water coming into the faucet (all not shown). That wire goes up to the LCD display in the front of the unit.

For installations in which no base assembly 12 is desired or necessary, opening 70 may be used to pass the threaded supply pipe 58 directly to a knurled nut 72. In such instances a cosmetic face plate may surround the pipe 58 intermediate base plate 68 and the bottom of the valve 14.

Base plate 68 is also provided with key-hole-shaped openings 160 and 162 which to assure proper orientation of the base assembly 12 in installation are not diametrically opposite each other. The tapered or key-hole-shaped openings 160 and 162 both are oriented in the same rotary direction.

The threaded pipe 58, which is to the side of the center line of the circular base of the housing 18, fits through the opening 70 which is equally offset from the center of plate 68. The threaded lower end of supply pipe 58 extends below the plate 68 and the fittings and as well as the LCD wire extend through the openings 154 as indicated. The plate 68 is raised to fit snugly against the shoulder 66 at the bottom of the housing, the keys (not shown) disposed in the keyways 150 of plate 68. The knurled nut 72 is then screwed onto supply pipe 58 against the bottom of the plate 68 firmly to attach together the valve 14 with its spout 16 and the base assembly 12.

Figure 2:
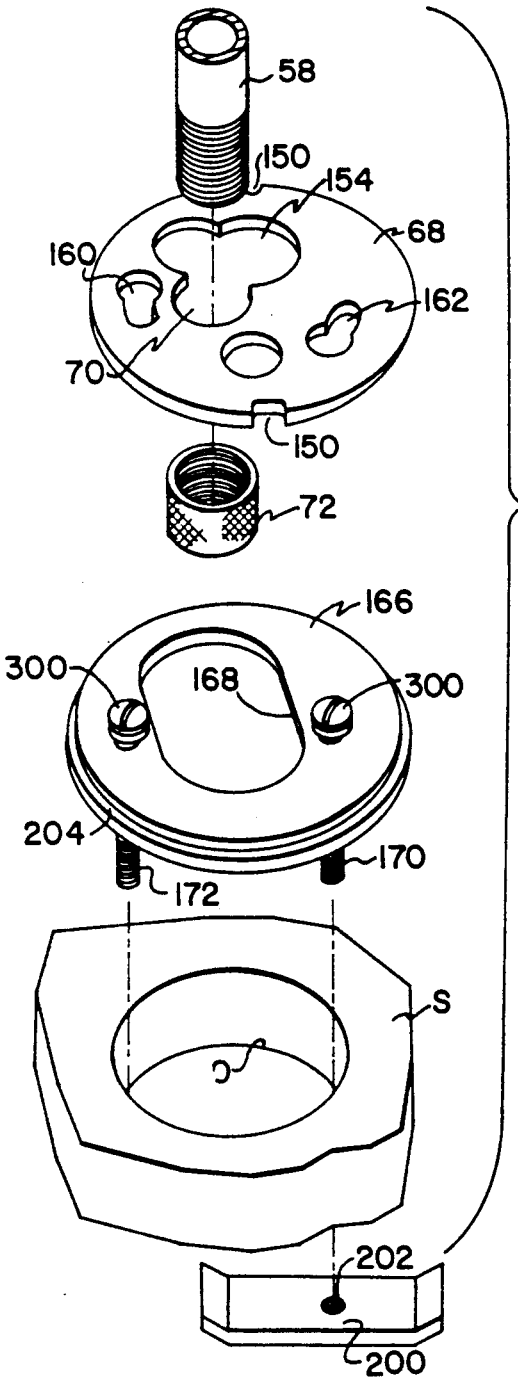
FIG. 2 is an exploded view showing the components relating to the installation of the faucet.

A circular installation plate 166 of the same diameter as plate 68, is also provided (FIG. 2). As shown, the plate 166 is formed with a large single access opening 168 generously formed and generally in line with the composite opening 70 and 154 of the base plate 68. A gasket 204 of slightly larger diameter is provided beneath the plate 166 (FIG. 2).

Figure 5:
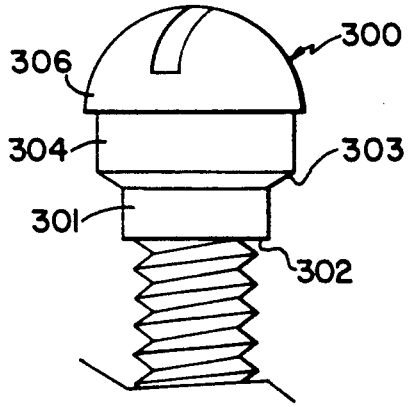
FIG. 5 is an enlarged fragmentary view of the attachment element of the invention.

As shown best in FIG. 2 the installation plate 166 is drilled to receive threaded fasteners 170 and 172. The fasteners each have on their upper ends attachment elements comprising heads. The heads each present (FIG. 5) a lower annular cylinder 301 having a shoulder 302 and having a tapered section 303 which underlies a cylindrical upper section 304 thereabove. Above the cylindrical section the attachment element may have a rounded dome 306 with a screwdriver slot thereacross. Obviously the attachment element may comprise an ordinary bolt with a stepped washer having the exterior shape described.

In installation, the shoulders 302 of the heads 300 butt against the connection plate 68. The threaded fasteners 168, 170 attach the installation plate 166 to the sink S or counter through a customary 1½" opening O. Such an opening is normally provided to the side of the hot and cold water outlets at the rear of the sink. The threaded part of the fasteners extend into the 1½" opening O. The lower end of the fasteners each receive an elongate clamping nut 200 (only one of which is shown) having upturned ends. The nut is drilled and tapped as at 202 to receive the fastener in threaded engagement. Alternatively, a "clip" nut or Tinnermann nut may be slipped over the nut 200 to align with hole 202 which is made ample and unthreaded in such a variation. A gasket 204 underlies the plate 168 and extends therebeyond in all directions (FIG. 1).

More specifically, the installation plate 166 is secured to the sink S by placing it over the opening 0. With the plate 166 in this position the threaded length of the fasteners extend down through the opening 0 with the clamping nuts disposed under the lower surface of the sink adjacent the opening 0. Through the access opening 168 (FIG. 2), the installer will be able to reach down with his finger and maneuver the clamping nuts so that as the fasteners 170, 172 are tightened, the nuts 200 raise to engage the undersurface of the sink to clamp the sink between the plate 166 and the nut 200. The upturned ends of nut 200 serve when the bolt 176 is tight to bite into the sink and immobilize the plate 166 in proper position.

In the further step of installation the preassembled base assembly 12 and valve 14, as described above, is aligned above the installation plate 166. The supply pipe 58, the inlet and outlet hoses and the LCD wire are fed down through access 168 to be connected under the sink as is appropriate. The base assembly 12 is then brought down over plate 166 so that the outer portions of the key-hole-shaped openings 160 and 162 of plate 68 receive the heads 300 respectively.

Figure 3:
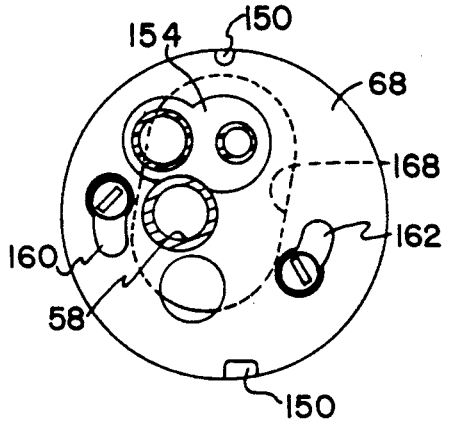
FIG. 3 is a sectional view taken on the line 3—3 of FIG. 1 showing the installation means of the invention and showing the parts prior to final installation position.
Figure 4:
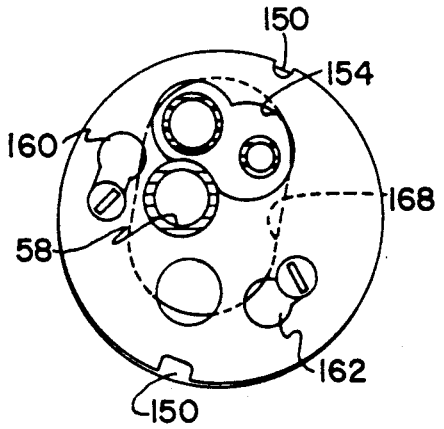
FIG. 4 is a sectional view like FIG. 3 but showing the parts in final position.

The base assembly is then pressed down so that the gasket 204 is squeezed between the bottom of the housing 18 and the sink top. The base assembly 12 is then turned in a clockwise direction (FIGS. 3, 4) until the heads wedge into the smaller parts of the key-hole-shaped openings **160*a* and 162*a*** respectively.

The amount of turning of the base assembly necessary may be only a matter of 10°–20° or so and yet the accessory faucet 10 is thereby firmly installed on the sink. The incline 303 on the fasteners 300 helps draw the plate 68 down. The gasket 204 serves to hold the plates firmly interlocked with the heads 300 engaging the smaller part of the key-hole-shaped openings 160, 162. The gasket also seals the base assembly to the sink so that water cannot seep into the housing and putrify.

MODIFIED FORM OF THE INVENTION

Figure 6:
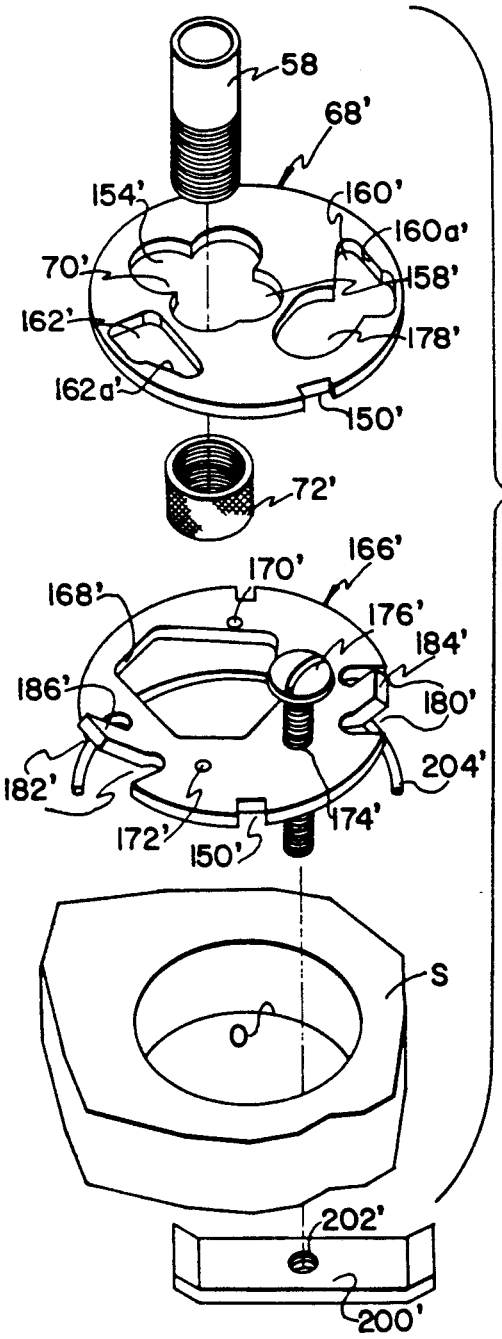
FIG. 6 is an exploded view showing modified components relating to the installation of the faucet.

As already described and as shown in FIG. 6, the base plate 68' which closes the housing 18 is formed with a supply-pipereceiving aperture 70'.

Figure 7:
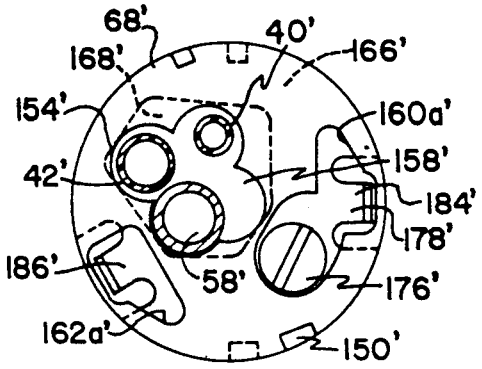
FIG. 7 is a sectional view taken at the position of line 3—3 of FIG. 1 showing the installation means of the invention and showing the parts prior to final installation position.
Figure 8:
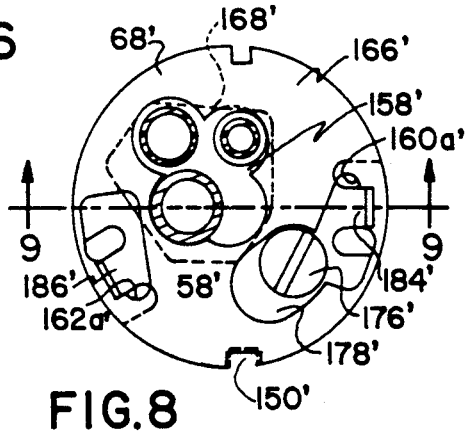
FIG. 8 is a sectional view like FIG. 7 but showing the parts in final position.
Figure 9:
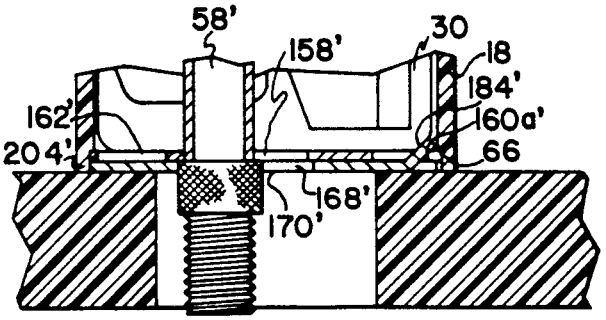
FIG. 9 is a fragmentary sectional view on the line 9—9 of FIG. 8.

As shown, the base plate 68' is circular and is formed with keyways 150' in its periphery. In assembly the keyways 150' receive short longitudinal ribs (not shown) to keep the base plate 68'' keyed to the rotation of the housing 18 as the unit is installed. Plate 68' is formed with opening 70' and enlarged aperture 154' (FIG. 6) which receives the brine outlet hose and fitting 42' and brine inlet hose and fitting 40' (FIG. 7) as well as the wire from the water quality monitoring device described earlier. That wire goes up to an LCD display in the front of the base assembly as disclosed in the parent application.

For installations in which no base assembly 12 is desired or necessary, opening 158' part of enlarged aperture 154' and which is central in the plate 68', may be used to pass the threaded supply pipe 58' directly to the knurled nut 72'. In such instances a cosmetic face plate may surround the pipe 58' intermediate base plate 68' and the bottom of the valve 14.

Base plate 68' is also provided with shoe-shaped openings 160' and 162' which to assure proper orientation of the base assembly 12 in installation are not diametrically opposite each other. The shoe-shaped openings 160' and 162' are formed with their inclined surfaces **160*a'* and 162*a'* inclined away from the periphery of the plate 68' as the "point" of the "shoe" is approached The "shoes" of the apertures 160' and 162'** both point in the same rotary direction.

In installation the threaded pipe 58, which is to the side of the center line of the circular base of the housing 18, fits through the opening 70' which is equally offset from the center of plate 68'. The threaded lower end of supply pipe 58' extends below the plate 68' and the fittings 40' and 42' as well as the LCD wire extend through the openings as indicated. The plate 68' is raised to fit snugly against the shoulder 66 at the bottom of the housing, the keys (not shown) disposed in the keyways 150' of plate 68'. The knurled nut 72' is then screwed onto supply pipe 58 against the bottom of the plate 68' firmly to attach together the valve 14 with its spout 16 and the base assembly 12.

A circular installation plate 166' of the same diameter as plate 68', is also provided (FIG. 6). As shown, the plate 166' is formed with a large single access opening 168' generously formed and generally in line with the composite opening 70', 154', and 158' of the base plate 68'. On either side of the access hole 168' are downstruck dimples 170', 172' which result in downward nibs (not shown) on the underside of plate 166', and a hole 174' receives a headed fastener, preferably a bolt 176'.

As shown best in FIG. 6 the periphery of the installation plate 166' is formed with pairs of parallel inward notches, or slits 180' and 182' and the portion of the periphery therebetween is struck upwardly as shown to define tongues 184' and 186'.

The threaded fastener 176' secures installation plate 166' to the sink S or counter through a customary 1½" opening 0, normally provided to the side of the hot and cold water outlets at the rear of the sink. The downstruck nibs (beneath dimples 170', 172') abut the margin of the 1½" opening 0. In instances where the opening 0 is smaller than 1½" appropriately located dimples or holes (not shown) may be made in the sink or counter top S so as to align with and receive the downward nibs formed in the undersurface of the installation plate 166' under the dimples 170' and 172' impressed therein. The lower end of the bolt 176' receives an elongate clamping nut 200' having upturned ends. The nut is drilled and tapped as at 202' to receive the bolt 176' in threaded engagement.

The installation plate 166' is secured to the sink S by placing it over the opening 0 so that the nibs beneath the dimples 170' and 172' abut the edge of the opening 0 or are received into the dimples (not shown) in the top of the sink as described above. With the plate 166' in this position the threaded length of the bolt 176' extends down through the opening 0 with the clamping nut 200' disposed under the lower surface of the sink adjacent the opening 0.

Through the access opening 168', the installer will be able to reach down with his finger and maneuver the clamping nut 200' so that as the bolt 176' is tightened, the nut 200' raises to engage the undersurface of the sink to clamp the sink between the plate 166' and the nut 200'. The upturned ends of nut 200' serve when the bolt 176' is tight to bite into the sink. Under such compression the ends of the nut and the downward nibs under dimples 170' and 172' on the plate 166 immobilize the plate 166' in proper position.

In the further step of installation the preassembled base assembly 12 and valve 14, as described above, is aligned above the installation plate 166'. The supply pipe 58, the inlet and outlet hoses I and 0 and the LCD wire are fed down through access 168' to be connected under the sink as is appropriate. A sealing O-ring 204' (FIG. 2) may surround the plate 166'. The base assembly 12 is then brought down over plate 166' so that the outer portions of the shoe-shaped openings 160' and 162' receive the tongues 184' and 186' respectively. The base plate 68' is also formed with a clearance opening 178' to accommodate the head of the bolt 176' as the plates 68' and 166' turn relatively in installation.

The base assembly is then pressed down so that the O-ring 204' is squeezed between the bottom of the housing and the sink top. The base assembly 12 is then turned in a clockwise direction (FIGS. 13, 14) until the tongues 184', 182' wedge against the inclined openings **160*a'* and 162*a'*** respectively.

The amount of turning of the base assembly necessary may be only a matter of 10°-20° or so and yet the accessory faucet 10 is thereby firmly installed on the sink. The incline of tongues 184' and 186' helps hold down the plate 68. The O-ring 204' serves to hold the plates firmly interlocked with the tongues 184', 186' engaging the inclines **160*a'*, 162*a'***. The O-ring also seals the base assembly to the sink so that water cannot seep into the housing and putrify.

It should be clear that there are decided advantages of the various aspects of the invention over the prior art. The invention may take the form of many different embodiments and hence is not limited to the structure described above and shown in the drawings. Instead, the invention may be defined by the following claim language or reasonable equivalents thereof.

What is claimed is:

1. An accessory faucet for installation on a sink or counter top over an access opening, the faucet including a threaded inlet pipe for connection to a water inlet, a faucet outlet portion, the threaded pipe and the faucet outlet portion having a common axis, a valve housing and a base assembly under the housing, both positioned between the threaded pipe and the faucet outlet, valve means in the valve housing for controlling flow into the faucet outlet portion, means connecting the valve housing to the threaded pipe, a base plate having an aperture therein, the base plate aperture receiving the threaded pipe, immobilizing means holding the base plate on the pipe against movement with respect thereto, an installation plate substantially the same diameter as the base plate, and having an opening for the pipe, means securing the installation plate to the sink over the access opening, the installation plate having at least two spaced upstanding elements having downwardly inclined locking surfaces, the base plate being formed with holes aligned respectively with the elements, each hole narrowing in the same rotary direction whereby the faucet can be mounted on the sink by inserting the pipe into the opening in the installation plate, aligning the elements and the wider portion of the holes, juxtaposing the plates and turning the base plate so that the inclined locking surfaces wedge against the margins of the narrower part of the holes, and resilient gasket means disposed under the base assembly urging it upward to enhance the wedging action.

2. An accessory faucet as claimed in claim 1 wherein a base assembly containing an air break module is fixedly disposed between the valve housing and the base plate and inlet and outlet to the module passes through appropriate openings in the base plate and the installation plate.

3. An accessory faucet as claimed in claim 1 wherein the base plate is keyed by key means to the bottom of the base assembly to prevent it from turning, and a nut on the pipe holds the base plate up in the bottom of the base assembly, the keying means and the nut comprising the immobilizing means.

4. An accessory faucet as claimed in claim 1 wherein the means securing the installation plate comprises a threaded fastener extending through the access opening and engaged between the installation plate and a clamping nut pressing up against the bottom of the sink whereby the sink is clamped between the installation plate and the clamping nut.

5. An accessory faucetlas claimed in claim 4 wherein the means securing the installation plate further comprises a nib formed on the underside of the installation plate abutting a vertical margin in the sink top.

6. An accessory faucet as claimed in claim 5 wherein the indentation is the access opening.

7. An accessory faucet as claimed in claim 4 wherein the upper end of the threaded fastener comprises the locking elements and the holes are key-hole-shaped.

8. An accessory faucet for installation on a sink or counter top over an access opening, the faucet including a threaded inlet pipe for connection to a water inlet; a faucet outlet portion, the threaded pipe and the faucet outlet portion having a common axis, a valve housing positioned between the threaded pipe and the faucet outlet, valve means in the housing for controlling flow into the faucet outlet portion, means connecting the valve housing to the threaded pipe, a base plate having an aperture therein, the base plate aperture receiving the threaded pipe, immobilizing means holding the base plate on the pipe against movement with respect thereto, an installation plate substantially the same shape as the base plate, and having an opening for the pipe, means securing the installation plate to the sink over the access opening, the installation plate having at least two spaced upstanding outwardly directed tongues struck up from the installation plate, the base plate being formed with holes aligned respectively with the tongues, the holes having outer margins inclined so as to be closer to the center of the plate at the same ends thereof whereby the faucet can be mounted on the sink by inserting the end of the pipe into the opening in the installation plate, aligning the tongues and holes, juxtaposing the plates and turning the base plate so that the tongues wedge against the margins of the holes in the base plate.

9. An accessory faucet as claimed in claim 8 wherein a base assembly containing an air break module is fixedly disposed between the valve housing and the base plate and inlet and outlet to the module passes through appropriate openings in the base plate and the installation plate.

10. An accessory faucet as claimed in claim 9 wherein the base plate is keyed by keyed means to the bottom of the base assembly to prevent it from turning and a nut on the pipe holds the base plate up in the bottom of the base assembly, the keying means and the nut comprising the immobilizing means.

11. An accessory faucet as claimed in claim 8 wherein the means securing the installation plate comprises a threaded fastener extending through the access opening and engaged between the installation plate and a clamping nut pressing up against the bottom of the sink whereby the sink is clamped between the installation plate and the clamping nut.

12. An accessory faucet as claimed in claim 11 wherein the means securing the installation plate further comprises a nib formed on the underside of the installation plate abutting a vertical margin of an indentation in the sink top.

13. An accessory faucet as claimed in claim 12 wherein the indentation is the access opening.

* * * * *